US006935662B1

(12) United States Patent
Hauber et al.

(10) Patent No.: US 6,935,662 B1
(45) Date of Patent: Aug. 30, 2005

(54) ONE-TOUCH-ACTUATED MULTIPOINT LATCH SYSTEM FOR DOORS AND WINDOWS

(75) Inventors: Peter Hauber, Solvang, CA (US); John Miller, Tukwila, WA (US)

(73) Assignee: Builders Hardware Inc., Buellton, CA (US)

( * ) Notice: Subject to any disclaimer, the term of this patent is extended or adjusted under 35 U.S.C. 154(b) by 44 days.

(21) Appl. No.: 10/689,960

(22) Filed: Oct. 20, 2003

Related U.S. Application Data

(63) Continuation of application No. 10/002,530, filed on Nov. 15, 2001, now Pat. No. 6,637,784.

(60) Provisional application No. 60/325,845, filed on Sep. 27, 2001.

(51) Int. Cl.[7] ..... E05C 19/00

(52) U.S. Cl. ..... 292/302; 292/116

(58) Field of Search ..... 292/300, 302, 292/116, 117, 341.15, DIG. 46, 56, 156–158, 161

(56) References Cited

U.S. PATENT DOCUMENTS

| | | | | | |
|---|---|---|---|---|---|
| 972,769 | A | * | 10/1910 | Lark | 292/157 |
| 4,834,161 | A | * | 5/1989 | Johnson et al. | 160/84.08 |
| 5,388,875 | A | * | 2/1995 | Fleming | 292/37 |
| 5,642,909 | A | * | 7/1997 | Swan et al. | 292/39 |

* cited by examiner

*Primary Examiner*—Gary Estremsky
(74) *Attorney, Agent, or Firm*—Louis J. Bachand

(57) ABSTRACT

Plastic window and doors are effectively latched to surrounding plastic frames by a distributed series of latches pins that are carried on a common carrier opposite and coaxial with a like series of apertures for simultaneous shifting between latched and unlatched conditions from a single point. A series of latch pins mates with an opposing series of cammed apertures that engage the pins when relatively shifted by a single turn of one actuator.

12 Claims, 4 Drawing Sheets

18
40
24
10a
12
26
42
36
38
14
10b
16
72
43
82
74
78
44
24
10c
68
45
14
8

14
18
8
68
58
92
36
94
38
112
114
422
62
16
12
42
10a
28
421
52
46
424
10
10b
62
10b
40
43
64
97
423
96
96
53
36
84
48
74
76
82
78
72
98
24
32
26
426
10c
44
54
10c
102
62
425
102
34
108
55
66
45
112
114
104
68
106
66
40

ONE-TOUCH-ACTUATED MULTIPOINT LATCH SYSTEM FOR DOORS AND WINDOWS

RELATED APPLICATION

This application is a continuation of my application Ser. No. 10/002,530, filed Nov. 15, 2001, now U.S. Pat. No. 6,637,784, issued Oct. 28, 2003, which application claims the benefit of U.S. Provisional Application Ser. No. 60/325,845, filed Sep. 27, 2001.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to latches and more particularly to latches for door and window openings. In accordance with the invention distributed multiple latches are singly actuated to better and more easily close longitudinally extended openings, particularly those where the movable door or window panel and the surrounding frame are made of plastic that tends to yield locally under prying entry force at a point spaced from the typical single latch connection.

2. Description of the Related Art

Numerous latches are known. The problem of fixing doors and windows that have extended lengths to their surrounding frames has been addressed by using multiple latches at spaced locations along the door length. This is unsightly and costly, as well as inconvenient to the user, as the latch mechanisms are replicated and must be actuated over and over each time window or door access is needed. Plastic frame windows and ors tend to be more flexible than their metal and wood counterparts and to yield more easily to unwanted entry along their lengths in the absence of multiple latching.

BRIEF SUMMARY OF THE INVENTION

The foregoing and other objects of the invention are realized in a latch assembly for closing a door or window opening to a fixed frame having a longitudinal extent at multiple locations distributed along the extent with a single latching movement, the assembly comprising a longitudinally extended keeper having at least three apertures in distributed longitudinally spaced array, the keeper being mounted to one side of the opening, a cooperating longitudinally extended latch structure comprising a longitudinally shiftable carrier carrying a corresponding number of distributed latch pins selectively engageable with the apertures and a carrier shifting guide, the latch structure being mounted to the other side of the opening in keeper opposed relation, and a hand operable actuator for shifting the carrier and latch pins along the carrier guide between engaged and nonengaged conditions of the latch pins with the apertures.

In this and like embodiments, typically, the keeper comprises a keeper bar mountable to the opening one side, the keeper bar having a raised center section flanked by flanges that are attached to the opening one side, the apertures being formed in the keeper center section to receive the latch pins in keeper center section passing relation, the apertures being cam-shaped to receive and retain the latch pins as a function of longitudinally shifting of the latch pins within the apertures, the latch structure comprises a latch bar mountable to the opening other side, the latch bar having a raised center section flanked by exterior flanges that are attached to the opening other side, the latch structure center section defining a slot opposite each the latch pin for longitudinal movement of latch pins, the latch structure comprises a latch bar mountable to the opening other side, the latch bar having a raised center section flanked by exterior flanges, the center section defining opposed interior flanges, the interior flanges forming a guideway within the center section that receives the carrier in sliding relation, the carrier is spring biased against latch pin engagement with the apertures, the actuator locking the latch pins into aperture engagement against the spring bias, the latch structure further comprises a plurality of guide pins, the keeper defining a corresponding plurality of guide pin receivers distributed between the apertures for aligning the keeper and latch structure in the closed condition of the door or window, and the actuator comprises a lever and a lever operated tongue that engages with the carrier in latch pin shifting relation.

The invention further provides the combination of the foregoing latch assembly and a window or door in the frame, such as one made of wood, metal or plastic.

In a further embodiment, the invention provides a latch assembly for closing a movable plastic door or window panel having a leading edge to an opposing edge of a frame in an opening having a fixed side defined by the frame and a movable side defined by the plastic window or door panel at multiple locations distributed along the frame and panel longitudinal extents with a single latching movement, the assembly comprising a longitudinally extended metal keeper having at least three apertures in distributed longitudinally spaced array, the keeper being mounted to the movable side of the opening, a cooperating longitudinally extended metal latch structure comprising a longitudinally shiftable metal carrier carrying a corresponding number of distributed metal latch pins selectively engageable with the apertures and a metal carrier shifting guide, the latch structure being mounted to the opening fixed side in keeper opposed relation, and a hand operable actuator for shifting the carrier and latch pins along the carrier guide between engaged and nonengaged conditions of the latch pins with the apertures.

In this and like embodiments, typically, the keeper comprises a metal keeper bar mountable to the opening one side, the keeper bar having a raised center section flanked by flanges that are attached to the opening one side, the apertures being formed in the keeper center section to receive the metal latch pins in keeper center section passing relation, the apertures being keyhole-shaped to receive and retain the latch pins as a function of longitudinally shifting of the latch pins within the apertures, the latch structure comprises a metal latch bar mountable to the opening other side, the latch bar having a raised center section flanked by exterior flanges that are attached to the opening other side, the latch structure center section defining a slot opposite each the metal latch pin for longitudinal movement of latch pins, the latch structure comprises a metal latch bar mountable to the opening other side, the latch bar having a raised center section flanked by exterior flanges, the center section defining opposed interior flanges, the interior flanges forming a guideway within the center section that receives the carrier in sliding relation, the latch structure further includes a spring mount adjacent the carrier and within said latch bar center section, and a biasing spring anchored by the spring mount and arranged for biasing the carrier against latch pin engagement with the apertures, the actuator having a tongue passing through the latch bar center section, and engaging the latch bar against the spring bias in the locked condition of the latch assembly, and, the latch metal latch pins are headed pins, and in which the latch structure further comprises a plurality of nonheaded guide pins, the keeper defining a corresponding plurality of guide pin receivers distributed between the apertures for aligning the keeper and latch structure in the closed condition of the door or window.

In a further embodiment, the invention provides a latch assembly for closing a door or window opening at multiple locations with a single latching movement, the assembly comprising a longitudinally extended keeper having in longitudinally spaced array more than two multiple apertures adapted to keep a like array of latch pins in positionally adjusted relation, a cooperating longitudinally extended latch having in registered relation with the apertures and in longitudinally spaced array multiple latch pins, a latch housing opposing the keeper and receiving the latch in positionally adjustable relation, the keeper and latch defining more than two cooperating pairs of pins and apertures, and a hand operated actuator for simultaneously engaging each the pair of pins and apertures positionally adjusting the latch and keeper relative to the housing and keeper for keeping the latch pins simultaneously in the apertures with a single hand operation, the actuator being free of any locking engagement between the keeper and latch in the locked condition of the latch and the keeper.

In yet another embodiment, the invention provides a distributed closure system for window or door openings that comprise a frame and a movable panel that cooperates with the frame to close the opening, the closure system including an elongated keeper bar, the keeper bar defining a series of at least three longitudinally spaced and distributed keepers along the length of the opening, and a latch bar disposed generally parallel to and opposite the keeper bar in the closed condition of the opening, the latch bar defining a series of at least three projecting latch members generally opposite respective ones of the keepers, the keepers being adapted to selectively engage or not engage the latch members in keeper received relation in the closed condition of the opening responsive to simultaneous longitudinal shifting of the keepers and latch members, and an actuator acting to effect the simultaneous longitudinal shifting freely of any movement of the frame or panel.

In its method aspects, the invention contemplates a method of distributively latching window or door openings that comprise a frame and a movable panel that cooperates with the frame to close the opening, including maintaining an elongated keeper bar at one side of the opening to provide a series of at least three longitudinally spaced and distributed keepers along the length of the opening, maintaining a latch bar disposed generally parallel to and opposite the keeper bar in the closed condition of the opening to provide a series of at least three projecting latch members generally opposite respective ones of the keepers, and selectively engaging the latch members in keeper received relation in the closed condition of the opening responsive to simultaneous longitudinal shifting of the keepers and latch members, and an actuator acting to effect the simultaneous longitudinal shifting freely of any movement of the frame of panel.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
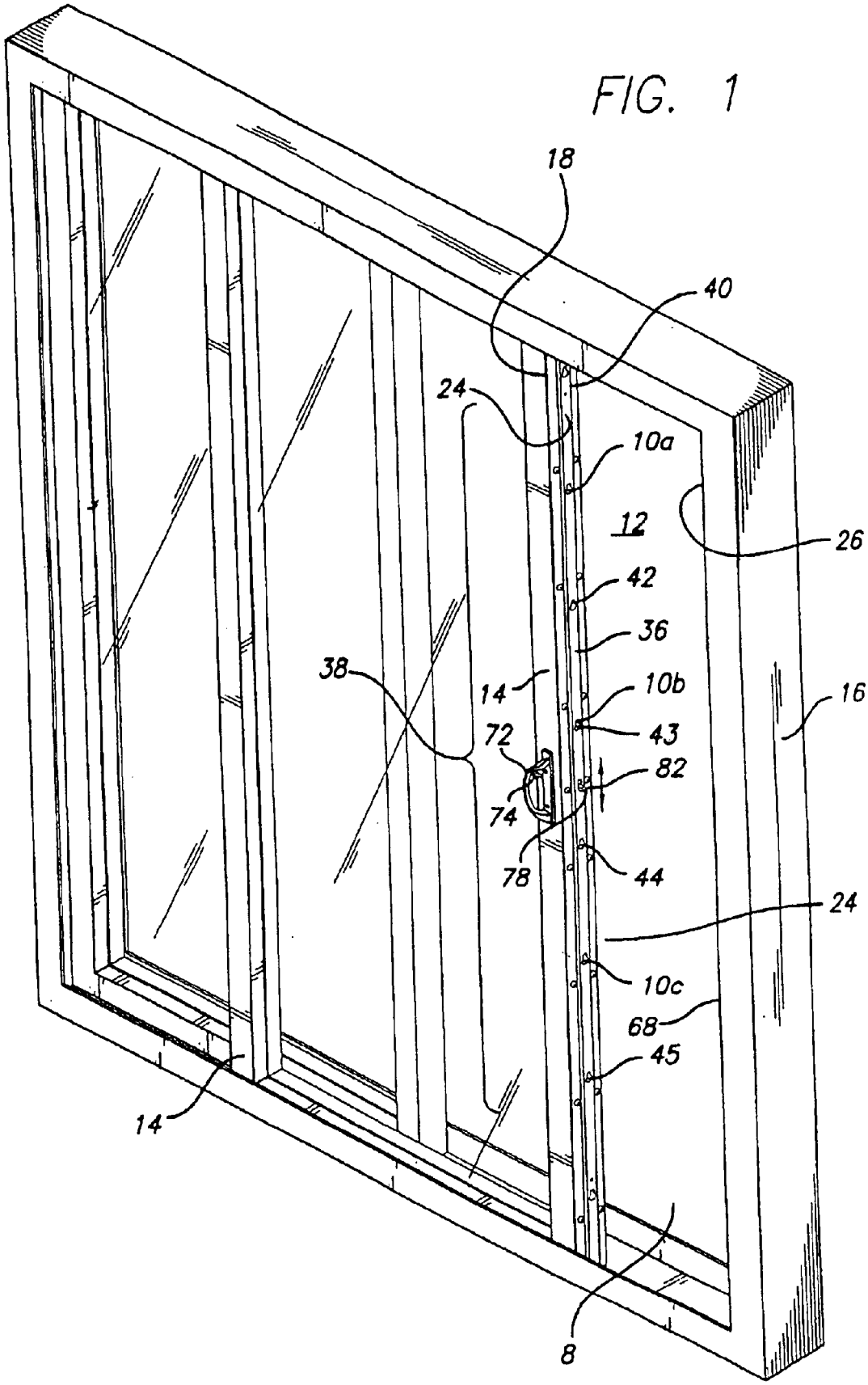
FIG. 1 is an oblique view of a window or door assembly having singly-actuated multiple latch points according to the invention.

With reference now to the drawings in detail, in FIGS. 1–4 the invention latch 8 comprises latch assembly 10 arranged and adapted for closing a door or window opening 12 by closing movable panel 14 to a fixed frame 16. Leading edge 18 of the panel 14 has a longitudinal extent 24; frame 16 has an opposing longitudinal extent 26. A number of individual latch assemblies 10*a,* 10*b,* 10*c,* etc. are provided, separated to be at multiple locations, e.g. 28, 32, 34 or more depending on the lengths of longitudinal extents 24, 26, and the number of latches needed for the degree of security desired. The invention allows for a virtually limitless number of latch assemblies 10*a, b, c . . . ,* and however many there are, they are all actuated from a single point.

That is, the assemblies 10*a, b, c . . .* are distributed to locations such as 28, 32 and 34 spaced along the opposed extents 24, 26 all for operation with a single latching movement as will be described.

Latch assembly 10 includes a longitudinally extended keeper 36 and a latch structure 46. Keeper 36 has at least three and preferably four or more apertures 42, 43, 44, and 45 distributed in a generally regular or nonregularly patterned longitudinally spaced array 38, as shown. Keeper 36 is mounted to one side of the opening 12, e.g. to side 40 defined by the leading edge 18 of the movable panel 14. Keeper 36 can be mounted to side 68 of the frame 16 in other embodiments.

Cooperating longitudinally extended latch structure 46 opposes the keeper 36. Latch structure 46 comprises a longitudinally shiftable carrier 58 carrying a corresponding number of distributed latch pins 52, 53, 54 and 55 distributed in a generally regular or nonregularly patterned longitudinal array 48 that matches the aperture array 38 so as to register apertures 42, etc. and pins 52 etc., as shown. Latch pins 52, 53 54 and 55 are arranged to selectively latchingly interengage with the keeper apertures 42, etc. and are suitably headed pins having a shank 62 and an enlarged head 64. Latch pins 52, 53, 54, and 55 are selectively engageable with the apertures 42, 43, 44, and 45 with the pin heads 64 passing through the apertures 42, etc. at the lower enlarged portions 421, 423, 425, etc. of the apertures in the unengaged condition and engaging when the heads 64 are behind the upper, narrowed portions 422, 424, 426, etc. of the apertures 42, 43 and 44. Latch structure 46 further comprises a carrier shifting guide 66 and spring biasing structure 85 for purposes to appear.

Latch structure 46 is mounted to the other side 68 of the opening 12 defined by the frame 16 in keeper opposed relation, and can be mounted to the panel leading edge 18 in other embodiments.

Figure 2:
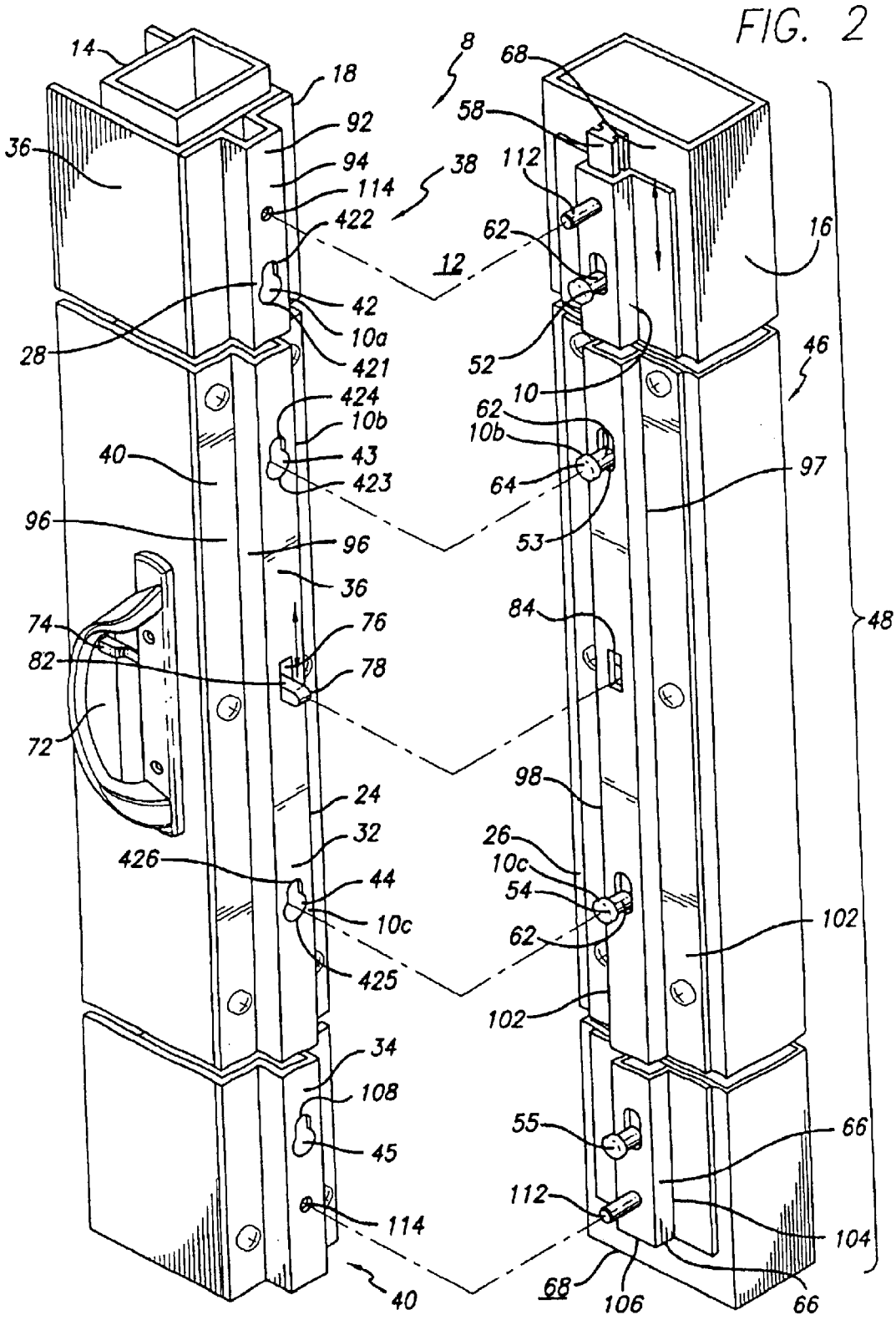
FIG. 2 is a front elevation view of the invention latch assembly in combination with a door or window movable panel and a frame.
Figure 2A:
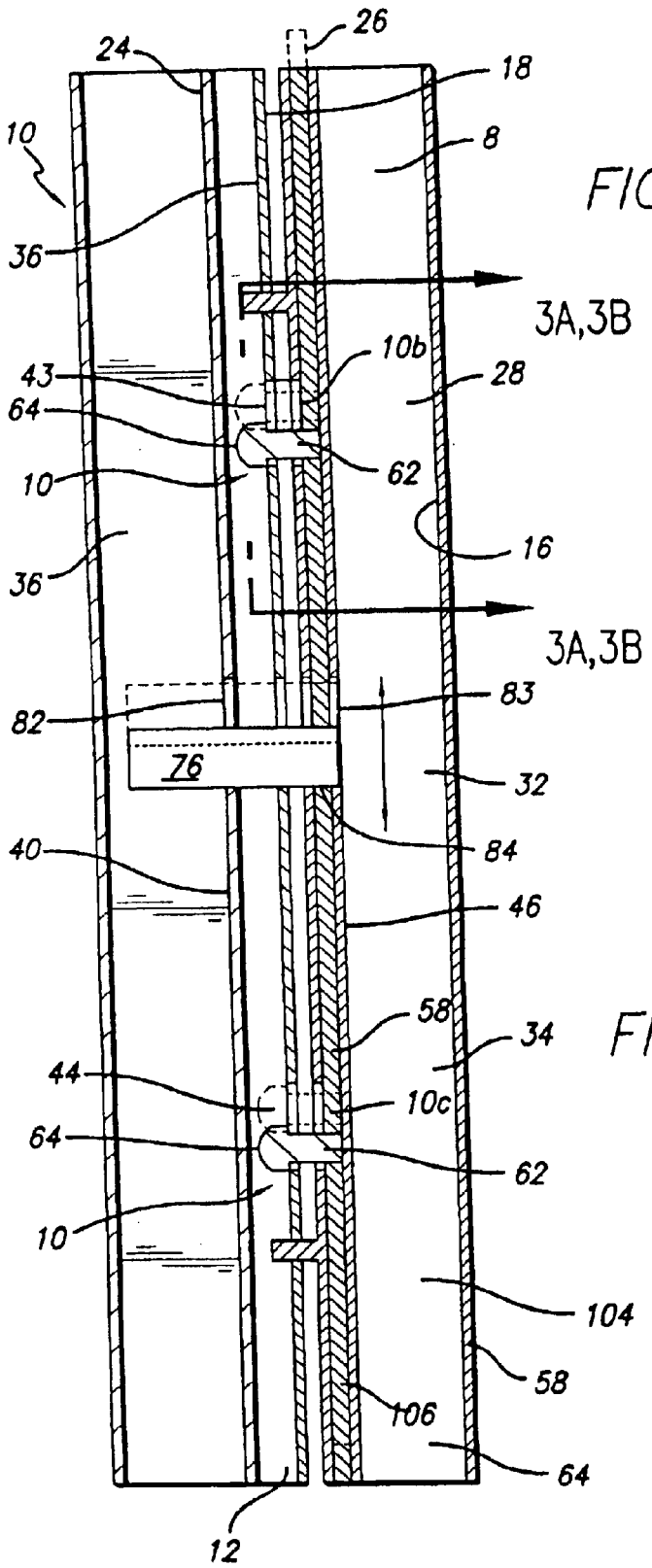
FIG. 2A is a detail view in longitudinal section thereof depicting the latching function.
Figure 3A:
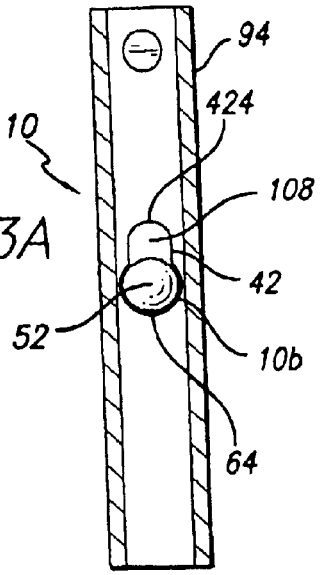
FIG. 3A is a view taken on line 3A—3A in FIG. 2A.
Figure 3B:
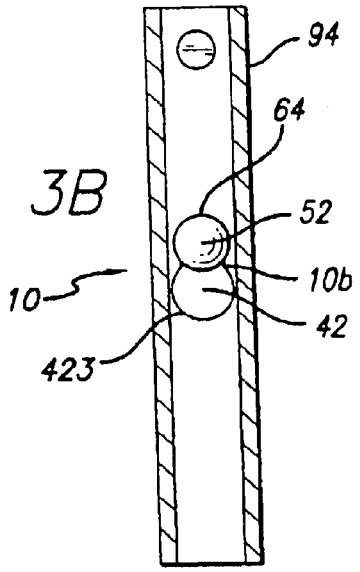
FIG. 3B is a view taken on line 3B—3B in FIG. 2A.
Figure 4:
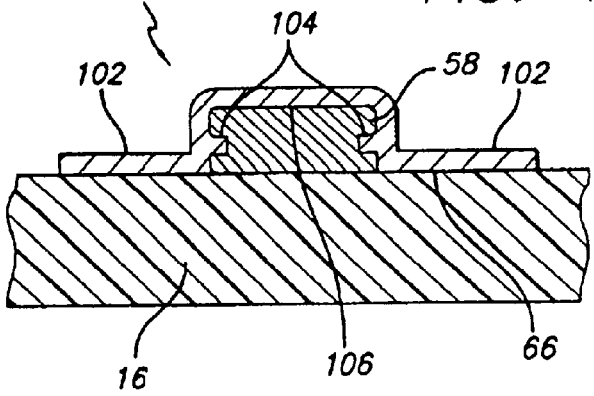
FIG. 4 is a view taken on line 4—4 in FIG. 5.

A hand-operable actuator 72 comprised of a thumb turn lever 74 of latch 76 actuates the latch tongue 78 to shift longitudinally, up and down, in the slot 82, as is known. In the invention the latch tongue purpose is not to itself latch, but to shift other pin components 52, 53, 54 and 55 of latches 10*a, b, c, . . .* relative to apertures 42, 43, 44 and 45 that effect latching by shifting the pin heads 64 behind the upper, narrower aperture portions 422, 424, 426, while the latch tongue simply serves the lifting and locking function. Thus, tongue 78 is used to shift the latch pins 52, 53, 54 and 55 and in the preferred embodiment shown has no hook and no latching function in and of itself. The absence of any hook or cam feature on the tongue 78 will be noted, as its function is to provide the shifting of the latch pins 52, 53, 54 and 55, rather that itself latching. Tongue 78 engages carrier 58 at recess 84 for purposes of shifting the carrier longitudinally. Carrier recess 84 is opposed to and offset from slot 82 to permit the required shifting by engagement of carrier shoulder 83 with tongue 78, as best shown in FIG. 2A. Shifting carrier 58 shifts the latch pins 52, 53, 54 and 55 by sliding the carrier 58 within the carrier guide 66 between engaged and nonengaged conditions of the latch pins with the apertures 42, 43, 44 and 45.

Figure 5:
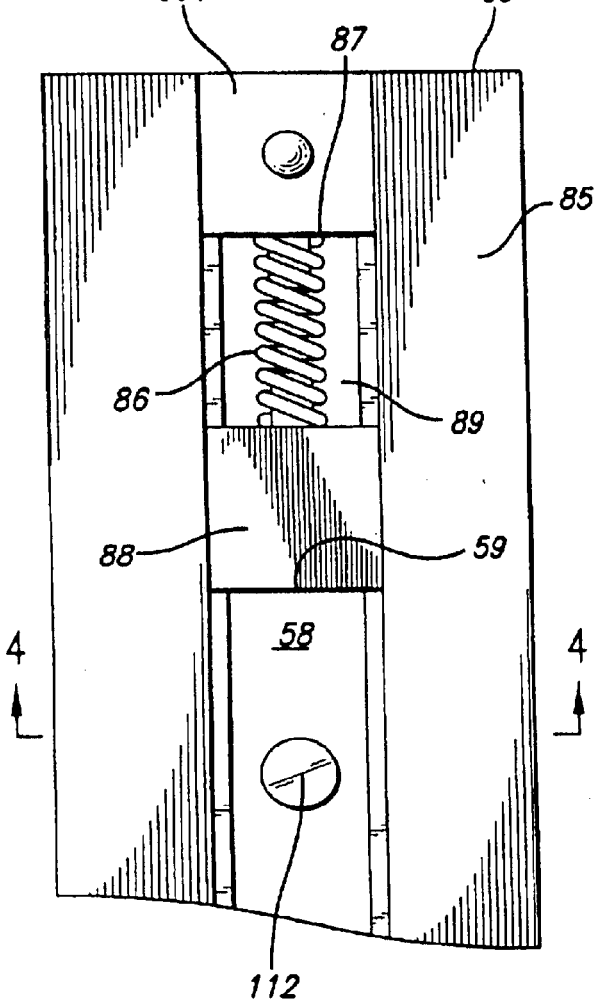
FIG. 5 is a fragmentary view of the carrier biasing structure in a retracted position; and, FIG. 6 is a view like FIG. 5 of the biasing structure in an extended position.
Figure 6:
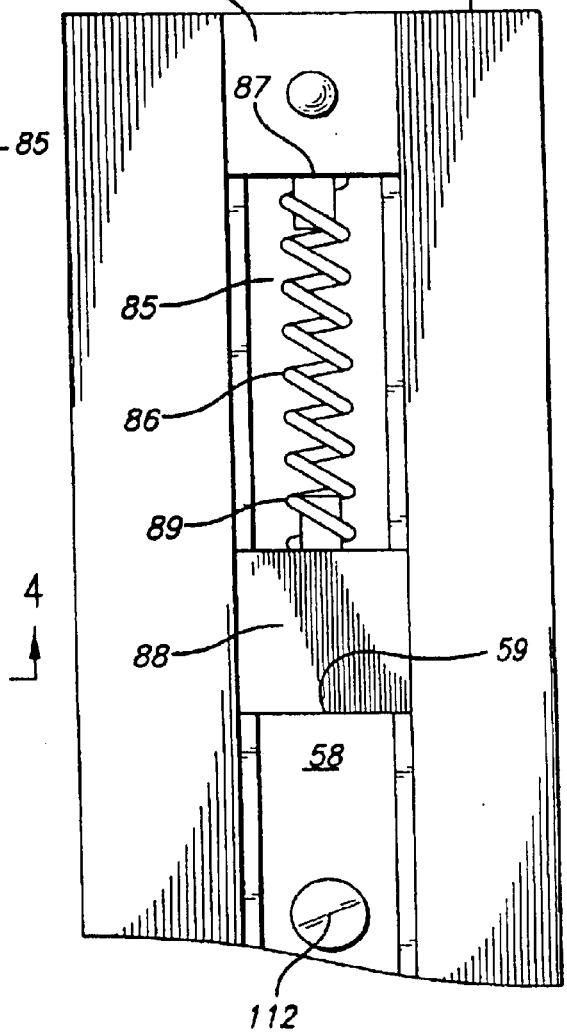

As best shown in FIGS. 5 and 6 the top 59 of the carrier 58 engages a biasing spring structure 85 comprising a compression spring 86 seated at 87 against a block 661 fixed to the carrier guide 66, Spring structure 85 biases a slide 88 engaged with the carrier 58 and shiftable in track 89 to push the carrier downward so that heads 64 of pins 52, etc. will be opposed only by the lower, larger portions 421, 423, 425 of the apertures 42, 43 and 44 and thus will be separable for unlatching purposes.

Typically, keeper 36 comprises a keeper bar 92 mountable to the opening one side 40. Keeper bar 92 is longitudinally dished to have a raised center section 94 flanked by flanges 96 that that are screwed or otherwise attached to the opening one side 40. Apertures 42, 43, 44 and 45 are formed in the keeper center section 94 to receive the latch pins 52, etc. in keeper center section passing relation. Generally, the apertures 42, 43. 44 and 45 are cam-shaped slots, e.g. keyhole-shaped slots as shown, to receive and retain the latch pins 52, 53, 54 and 55 as a function of longitudinally shifting of the latch pins within the apertures by shifting carrier 58.

Latch structure 46 typically comprises latch bar 97 mountable to the opening other side 68. Latch bar 97 has a raised center section 98 flanked by exterior flanges 102 that are screwed or otherwise attached to the opening other side 68. Latch structure center section 98 defines the cam slots 42, 43, 44, and 45 opposite respectively latch pins 52, 53, 54 and 55 to accommodate longitudinal movement of the latch pins relative to the center section.

Latch bar 97 further defines opposed interior flanges 104 that form a guideway 106 within the center section 98 that receives the carrier 58 in sliding relation to provide for longitudinal shifting of the carrier and its pins 52, 53, 54, and 55. Carrier 58 is spring biased against entry of latch pins 52, 53, 54 and 55 into and engagement with the smaller parts 422, 424, and 426 of the apertures 42, 43 and 44. Actuator 72 is typically of the over-center type so that once turned leverage is reversed and there is great resistance to unlatching under the force of the carrier 58 on the latch tongue 78, making unwanted door or window entry by reversing the latch action nearly impossible.

Latch structure 46 further comprises a plurality of cylindrical, non-headed guide pins 112 with the keeper 36 defining a corresponding plurality of guide pin receivers 114 distributed on the mating keeper and latch structure 36, 46, apart from the apertures 42, 43, 44 and 45 for aligning the keeper and latch structure in the closed condition of the door or window. Guide pins 112 are not attached to the carrier 58 but only to the latch structure center section 98, unless the center section 98 is slotted to accommodate their movement.

All latching parts discussed are preferably formed from metal or engineering plastic.

In its method aspects, the invention contemplates a method of distributively latching closed window or door openings 12 that comprise a frame 16 and a movable panel 14 that cooperates with the frame to close the opening, including maintaining an elongated keeper bar 92 at one side 40 of the opening to provide a series of at least three longitudinally spaced and distributed keepers e.g. 42, 44 and 45 along the length of the opening, maintaining a latch bar 97 disposed generally parallel to and opposite the keeper bar 92 in the closed condition of the opening 12 to provide a series of projecting latch members 52, 53, 54 and 55 generally opposite respective ones of the keepers 42, 43, 44, and 45 selectively engaging the latch members in keeper received relation in the closed condition of the opening responsive to simultaneous longitudinal shifting of the keepers and latch members, and an actuator 72 acting to effect the simultaneous longitudinal shifting freely of any corresponding movement of the frame 16 or panel 14.

The invention thus provides an improved latching system for door and window openings having distributed latching for longitudinally extended doors and windows that is operable by a single hand operation. The invention latching system provides a better plastic door or window and frame combination in which prying apart of the locked door and window and frame is precluded by having a distributed series of latches and keepers that are all actuated from a single point.

The foregoing objects are thus met.

We claim:

1. A latch assembly for closing a door or window opening to a fixed frame having a longitudinal extent at multiple locations distributed along said extent with a single latching movement, said assembly comprising a longitudinally extended keeper having at least three apertures in distributed, longitudinally spaced array, said keeper being mountable to one side of said opening, a cooperating longitudinally extended latch structure comprising a longitudinally shiftable carrier carrying a corresponding number of distributed latch pins selectively engageable with said apertures, respective pairs of said apertures and pins being relatively coaxially disposable and opposable, a carrier shifting guide, said latch structure being in keeper opposed relation, and an actuator for shifting said carrier and latch pins along said carrier guide between engaged and nonengaged conditions of said latch pins with said apertures, and spring biasing structure biasing said carrier against latch pin engagement with said apertures, said actuator locking said latch pins into aperture engagement against said spring bias.

2. The latch assembly according to claim 1, in which said keeper comprises a keeper bar mountable to said opening one side, said keeper bar having a center section, said apertures being formed in said keeper center section to receive said latch pins in keeper center section passing relation, said apertures being cam-shaped to receive and retain said latch pins as a function of longitudinally shifting of said latch pins within said apertures.

3. The latch assembly according to claim 1, in which latch structure comprises a latch bar mountable to said opening other side, said latch bar having a center section flanked by exterior flanges that are attached to said opening other side, said latch structure center section defining a slot opposite each said latch pin for longitudinal movement of latch pins.

4. The latch assembly according to claim 1, in which said latch structure comprises a latch bar mountable to said opening other side, said latch bar having a center section and forming a guideway that receives said carrier in sliding relation.

5. A latch assembly for closing a door or window opening to a fixed frame having a longitudinal extent at multiple locations distributed along said extent with a single latching movement, said assembly comprising a longitudinally extended keeper having at least three apertures in distributed, longitudinally spaced array, said keeper being mountable to one side of said opening, a cooperating longitudinally extended latch structure comprising a longitudinally shiftable carrier carrying a corresponding number of distributed latch pins selectively engageable with said apertures, respective pairs of said apertures and pins being relatively coaxially disposable and opposable, a carrier shifting guide, said latch structure being in keeper opposed relation, and an actuator for shifting said carrier and latch pins along said carrier guide between engaged and nonengaged conditions of said latch pins with said apertures, said latch structure further comprising a plurality of guide pins, said keeper defining a corresponding plurality of guide pin receivers distributed between said apertures for aligning said keeper and latch structure in the closed condition of said door or window.

6. The latch assembly according to claim 5 including also spring biasing structure biasing said carrier against latch pin engagement with said apertures, said actuator locking said latch pins into aperture engagement against said spring bias.

7. The latch assembly according to claim 1, in which said actuator comprises a hand-operated level and a lever-operated tongue that engages with said carrier in latch pin shifting relation.

8. In combination: the latch assembly according to claim 1 and a window or door and cooperating frame.

9. The combination according to claim 8, in which one or more of said window, door and frame is made of plastic.

10. In combination: the latch assembly according to claim 5 and a window or door panel and a frame.

11. The combination according to claim 10 in which said window or door panel and said frame are made of plastic.

12. A latch assembly for closing a movable plastic door or window panel to a frame in an opening having a fixed side defined by said frame and a movable side defined by said window or door panel at multiple locations distributed along the frame and panel longitudinal extents with a single latching movement, said assembly comprising a longitudinally extended metal keeper having at least three apertures in distributed longitudinally spaced array, said keeper being mounted to said movable side of said opening, a cooperating longitudinally extended metal latch structure comprising a longitudinally shiftable metal carrier carrying a corresponding number of distributed metal latch pins selectively engageable with said apertures and a metal carrier shifting guide, said latch structure being mounted to said opening fixed side in keeper opposed relation, respective pairs of said apertures and metal latch pins being relatively coaxially disposed and opposed across said opening in the open and closed condition of said door or window, and a hand operable actuator for shifting said carrier and latch pins along said carrier guide between engaged and nonengaged conditions of said latch pins with said apertures said apertures being keyhole-shaped to receive said metal latch pins in alternate coaxial positions and retain said metal latch pins as a function of longitudinally shifting of said latch pins within said apertures.

* * * * *